US007347031B2

(12) United States Patent
Callahan

(10) Patent No.: US 7,347,031 B2
(45) **Date of Patent: *Mar. 25, 2008**

(54) JOIST REINFORCING BRACKET

(76) Inventor: Robert M. Callahan, 225 Apple Rd., Boones Mill, VA (US) 24065

( * ) Notice: Subject to any disclaimer, the term of this patent is extended or adjusted under 35 U.S.C. 154(b) by 0 days.

This patent is subject to a terminal disclaimer.

(21) Appl. No.: 11/281,701

(22) Filed: Nov. 18, 2005

(65) Prior Publication Data

US 2006/0130425 A1 Jun. 22, 2006

Related U.S. Application Data

(63) Continuation of application No. 10/314,699, filed on Dec. 10, 2002, now abandoned, which is a continuation-in-part of application No. 09/796,531, filed on Mar. 2, 2001, now abandoned.

(51) Int. Cl.
*E04C 5/18* (2006.01)
*E04C 5/01* (2006.01)

(52) U.S. Cl. ..... 52/715; 52/712; 52/714; 52/696; 52/702; 52/220.8; 248/248; 248/300

(58) Field of Classification Search ..... 52/729.2, 52/729.5, 696, 702, 712, 715, 714, 278, 220.8; 248/247, 248, 300; D8/349
See application file for complete search history.

(56) References Cited

U.S. PATENT DOCUMENTS 3,034,185 A * 5/1962 Olsen ..... 403/347
4,160,350 A * 7/1979 Craib ..... 52/696
5,307,603 A * 5/1994 Chiodo ..... 52/698
5,833,179 A * 11/1998 VandenBerg ..... 248/65
6,269,606 B1 * 8/2001 McCown ..... 52/741.13
D472,791 S * 4/2003 Callahan et al. ..... D8/349
D472,792 S * 4/2003 Callahan et al. ..... D8/349

FOREIGN PATENT DOCUMENTS

GB 2119827 * 11/1983 ..... 52/714
GB 2177287 * 1/1987 ..... 248/248

* cited by examiner

*Primary Examiner*—Richard Chilcot
*Assistant Examiner*—Phi Dieu Tran A
(74) *Attorney, Agent, or Firm*—Stephen R. Greiner

(57) ABSTRACT

A bracket for reinforcing a wooden joist including a body having a central portion with a base wall. An upper portion is integrally formed with the central portion and has a first wall secured to and extending forwardly from the top of the base wall and a second wall secured to and extending from the front of the first wall. A notch in the top of the base wall extends upwardly through the first and second walls. A lower portion is integrally formed with the central portion and has a third wall secured to and extending at right angles from the bottom of the base wall and a fourth wall secured to and extending at right angles from the third wall. A brace is rigidly affixed to the base wall beneath the notch.

6 Claims, 3 Drawing Sheets

FIG. 1
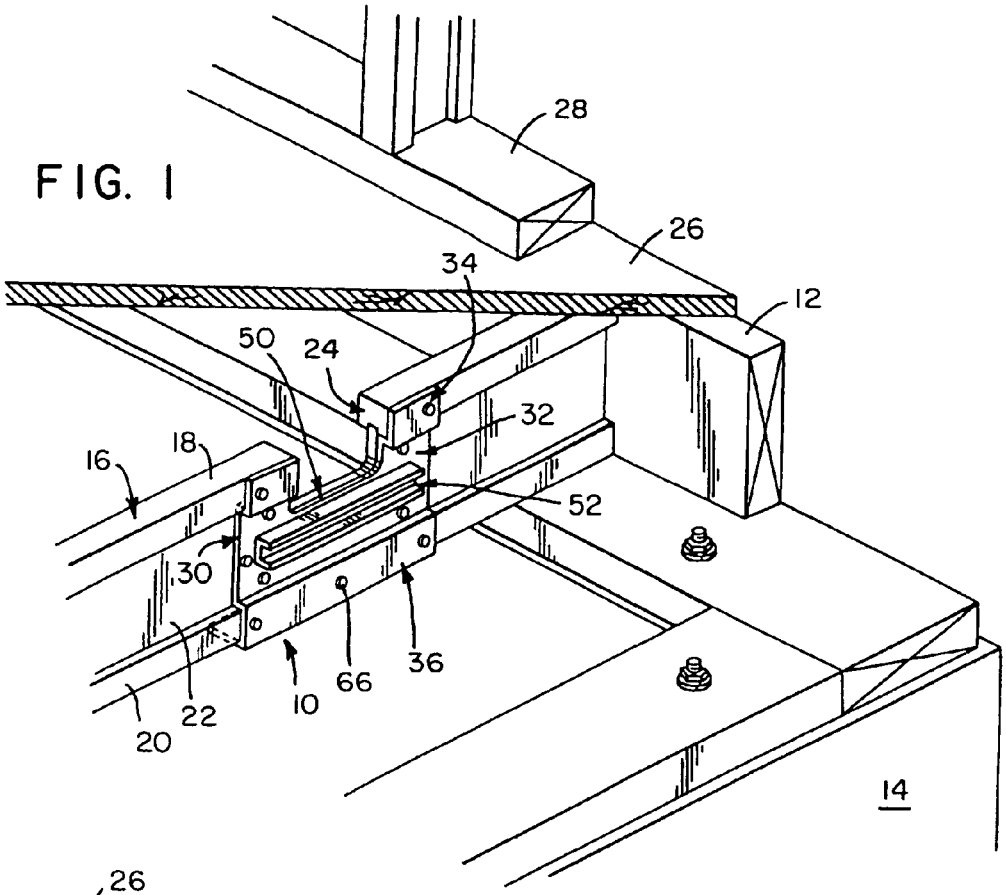
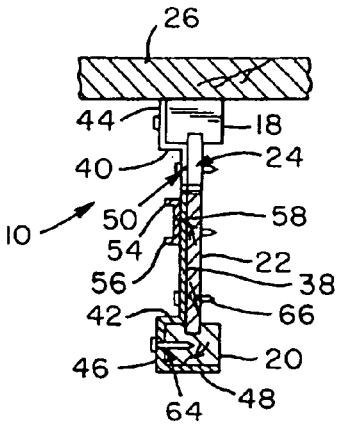
FIG. 3
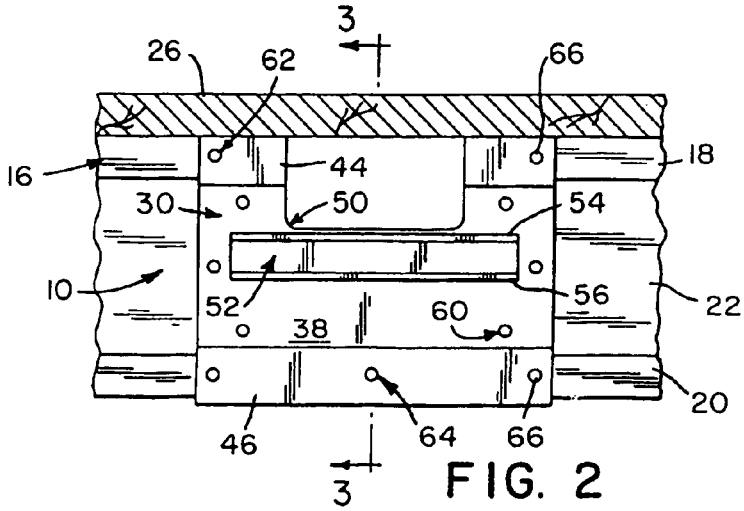
FIG. 2

JOIST REINFORCING BRACKET

CONTINUING APPLICATION DATA

This application is a continuation of U.S. patent application, Ser. No. 10/314,699, filed on Dec. 10, 2002 now abandoned, that is a continuation-in-part of a U.S. patent application, Ser. No. 09/796,531, filed on Mar. 2, 2001 now abandoned.

FIELD OF THE INVENTION

The present invention relates generally to static structures and, more particularly, to openwork brackets formed of sheet materials.

BACKGROUND OF THE INVENTION

Floor systems comprise the horizontal supporting surfaces of a building structure. Such floor systems not only support the contents of a building but also carry their own weight and any extra load from floors and walls above. To avoid collapse, a floor system must transfer loads laterally to beams, columns, or bearing walls with an adequate margin of safety.

In some buildings, a floor system is assembled from wooden joists overlaid with plywood sheathing. The dimensions of the lumber utilized may be varied somewhat and the floor system will still meet accepted standards for safety. Of course, holes or cavities within the floor system must be considered in determining the proper lumber dimensions.

For a variety of reasons, it is best to run utility conduits parallel to floor joists. Under certain conditions, however, conduits must run perpendicular to, and penetrate, joists. Local building codes strictly limit the size and location of any cutouts that are placed in joists for the passage of conduits. These codes have resulted largely in builders being required to "oversize" joists thereby adding cost and waste to many building projects.

In U.S. Pat. No. 5,519,977, we disclosed an uncomplicated bracket acting as a "patch kit" to return a wooden joist having a transverse hole to its original strength. Since the issuance of that patent, a need has arisen for a bracket capable of reinforcing a joist with a notch cut into its top. A notch, it has been found, is sometimes required to accommodate the passage of a conduit servicing a plumbing fixture or like item is located directly above a joist. Without reinforcement, the notch may compromise the structural integrity of the joist.

SUMMARY OF THE INVENTION

In view of the foregoing need, it is a principal object of this particular invention to provide a bracket for reinforcing a wooden joist with a notch cut into its top. The bracket can be attached to dimension lumber or composite materials such as joists having top and bottom flanges joined by an oriented strand board web. In any case, the bracket is easily attached using conventional hand tools and conventional fasteners by laborers with minimal training.

It is another object of the invention to provide a joist reinforcing bracket of the type described that has a high strength yet is uncomplicated in construction. The bracket preferably has only two principal components that are fastened together prior to distribution and use.

It is an object of the invention to provide improved elements and arrangements thereof in a joist reinforcing bracket for the purposes described which is lightweight in construction, inexpensive to manufacture, and fully dependable in use.

Briefly, the preferred bracket in accordance with this invention achieves the intended objects by featuring a base wall and a first intermediate wall extending forwardly from the top of the base wall. A second intermediate wall extends forwardly from the bottom of the base wall. A first front wall extends upwardly from the front of the first intermediate wall. A second front wall extends downwardly from the front of the second intermediate wall. The base wall has a notch in its top. The notch extends upwardly through the first intermediate wall and the first front wall thus bifurcating the first intermediate wall and the first front wall. A brace is secured to the base wall beneath the notch.

The foregoing and other objects, features and advantages of the present invention will become readily apparent upon further review of the following detailed description of the preferred embodiments as illustrated in the accompanying drawings.

BRIEF DESCRIPTION OF THE DRAWINGS

The present invention may be more readily described with reference to the accompanying drawings, in which:

FIG. 1 is a perspective view of a joist reinforcing bracket in accordance with the present invention positioned within a floor system.

FIG. 2 is a front view of the joist reinforcing bracket of FIG. 1.

FIG. 3 is a cross-sectional view taken along line 3-3 of FIG. 2.

Similar reference characters denote corresponding features consistently throughout the accompanying drawings.

DETAILED DESCRIPTION OF THE PREFERRED EMBODIMENTS

Figure 4:
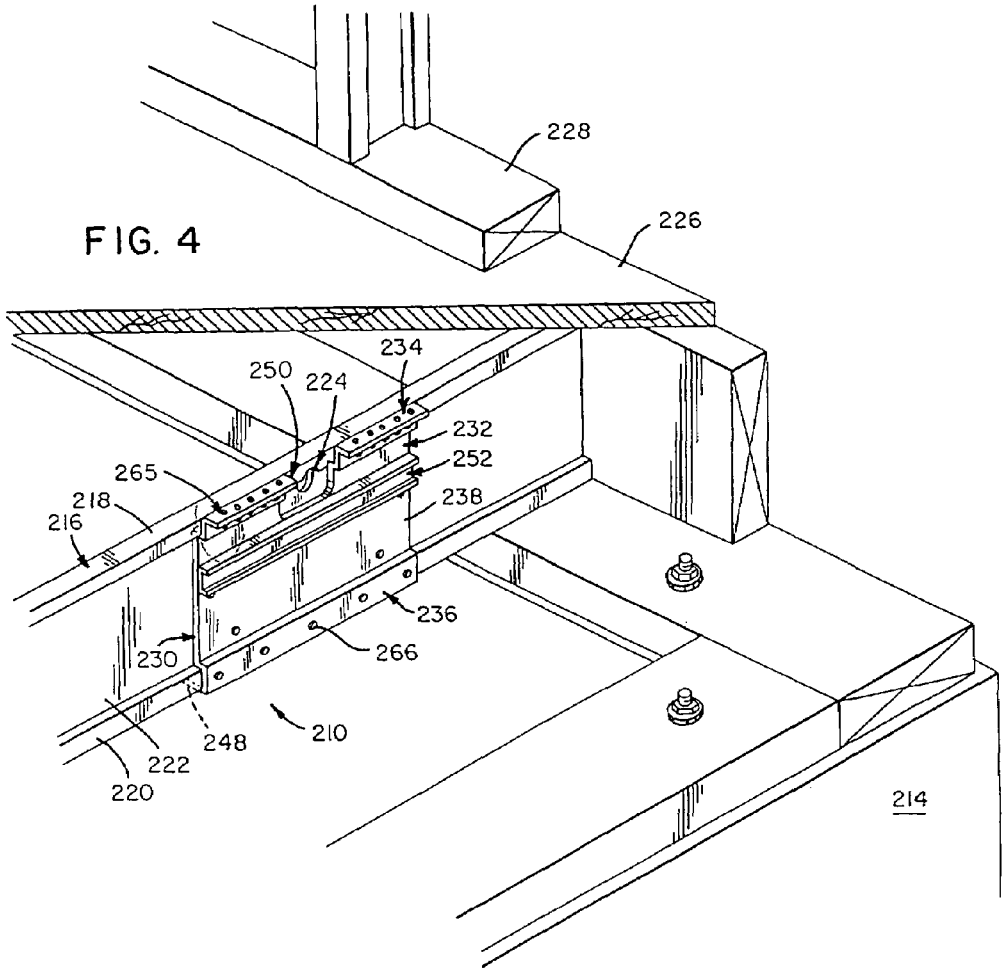
FIG. 4 is a perspective view of an alternative joist reinforcing bracket in accordance with the present invention positioned within a floor system.

Referring now to FIGS. 1 through 3, a joist reinforcing bracket 10 is shown in use with a conventional floor system. Floor system includes a header 12 supported at a fixed height by a base wall 14. A composite joist 16 formed of wood extends laterally from header 12 to a remote support (not shown). Joist 16 comprises a top flange 18 and a bottom flange 20 joined together by a web 22 in the manner of an I-beam. A notch 24 is cut through top flange 18 and into web 22 for the passage of one or more utility conduits (not shown). Atop header 12 and joist 16 is secured a plywood subfloor 26 for carrying one or more wall frames 28.

Although only one joist 16 is illustrated in FIG. 1, it should be understood that additional joists 16 would typically be used in the construction of a floor system. In such a system, a number of like joists 16 would be positioned along header 12 about 16 to 24 inches apart and a number of brackets 10 would be employed adjacent the notch 24 provided in each of the joists 16 for the passage of a conduit. Obviously, any number of brackets 10 may be secured to a single joist 16 for the passage of conduits at different locations.

Bracket 10 includes a body 30, formed of 18-gage, galvanized steel sheeting, having a central portion 32 joining an upper portion 34 and a lower portion 36 together. Central portion 32 is defined by a planar, base wall 38. Upper portion 34, however, has an intermediate wall 40 extending forwardly from the top of base wall 38 and a front wall 44 extending upwardly from the front of intermediate wall 40. Lower portion 36 has an intermediate wall 42 extending forwardly from the bottom of base wall 38, a front wall 46 extending downwardly from the front of intermediate wall 42, and also has a rearwardly-extending, bottom wall 48 being secured to the bottom of front wall 46. The right angle connections between adjacent walls 38-48 provide bracket 10 with great rigidity.

Body 30 has a notch 50 sized like notch 24 in joist 16 to accommodate the passage of mechanical and electrical conduits. Notch 50 extends downwardly from the top of front wall 44 through intermediate wall 40 and into the top of base wall 38. Notch 50 has a rectangular outline for ease of construction but may be provided with any desired outline.

Positioned beneath notch 50 is a brace 52 formed of 18-gage galvanized steel sheeting. Brace 52 includes a pair of forwardly-extending, interior walls 54 and 56 joined by a back wall 58 into a C-shape. Back wall 58 is welded to base wall 38 with interior walls 54 and 56 being oriented parallel to intermediate walls 40 and 42. Interior and back walls 54-58 being coextensive, brace 52 extends substantially the entire length of bracket 10.

A plurality of small holes 60, 62 and 64 are provided in body 30 that permit the passage of penetrating-type fasteners like screws or nails 66 to fasten bracket 10 to joist 16. Adjacent notch 50 and brace 52, a number of holes 60 are provided in base wall 38. Similarly, holes 62 are provided in front wall 44 on opposite sides of notch 50. Holes 64 are likewise provided along the length of front wall 46.

Should it be desired that bracket 10 be permanently affixed to joist 16, a layer of adhesive cement (not shown) may be applied to the rear surfaces of base and front walls 38, 44 and 46, the top surfaces of intermediate and bottom walls 40 and 48, and the bottom surface of intermediate wall 42 prior to their positioning adjacent joist 16. If adhesive cement of sufficient strength is used, it may be possible to install bracket 10 without any screws or nails 66. Thus, holes 60-64 may be omitted from body 30.

Figure 5:
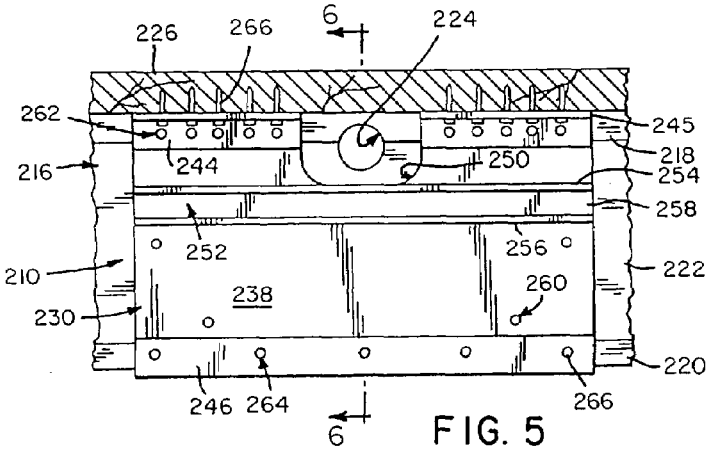
FIG. 5 is a front view of the joist reinforcing bracket of FIG. 4.
Figure 6:
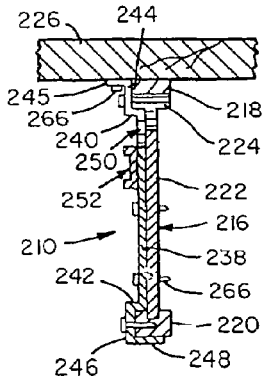
FIG. 6 is a cross-sectional view taken along line 6-6 of FIG. 5.

Referring now to FIGS. 4-6, an alternative embodiment of the joist reinforcing bracket is illustrated generally at 210. Bracket 210 includes elements that correspond generally with those of bracket 10 described above. Bracket 210 has, however, been modified so as to be stiffer than bracket 10 and to be attached with greater strength to a floor system including a header 212 supported by a base wall 214. The floor system also has a composite joist 216, having a top flange 218 and a bottom flange 220 joined by a web 222, extending from header 212. A notch 224 passes through top flange 218 and into web 222 for the passage of utility conduits (not shown). Atop header 212 and joist 216 is a subfloor 226 carrying at least one wall frame 228.

Bracket 210 includes a body 230 having a central portion 232 joining an upper portion 234 and a lower portion 236. Central portion 232 has a planar, base wall 238. Upper portion 234, however, has an intermediate wall 240 extending forwardly from the top of base wall 238, a front wall 244 extending upwardly from the front of intermediate wall 240, and a top wall 245 extending forwardly from the top of front wall 244. Lower portion 236 has an intermediate wall 242 extending forwardly from the bottom of base wall 238, a front wall 246 extending downwardly from the front of intermediate wall 242, and also has a rearwardly-extending, bottom wall 248 being secured to the bottom of front wall 246. The right angle connections between adjacent walls 238-248 provide bracket 210 with great rigidity.

Body 230 has a notch 250 sized to outline notch 224 in joist 216 to accommodate the passage of mechanical and electrical conduits through notch 224. Notch 250 extends downwardly from the top of top wall 245, through front wall 244 and intermediate wall 240, and into the top of base wall 238. Notch 250 has a rectangular outline.

Positioned beneath notch 250 is a brace 252 formed of 18-gage galvanized steel sheeting. Brace 252 includes a pair of forwardly extending, interior walls 254 and 256 joined by a back wall 258 into a C-shape. Back wall 258 is welded to base wall 238 with interior walls 254 and 256 being oriented parallel to walls 240, 242, 245 and 248. Interior and back walls 254, 256 and 258 are coextensive, and brace 252 extends the entire length of base wall 238.

A plurality of small holes 260, 262, 264 and 265 are provided in body 230 that permit the passage of penetrating-type fasteners like screws or nails 266 to fasten bracket 210 to joist 216. Adjacent notch 250 and brace 252, a number of holes 260 are provided in base wall 238. Similarly, holes 262 are provided in front wall 244 on opposite sides of notch 250. Holes 264 are likewise provided along the length of front wall 246. Holes 265 are provided along the length of top wall 245. Holes 260-265 can be omitted if bracket 210 is to be attached to joist 216 by means of adhesive cement.

Figure 7:
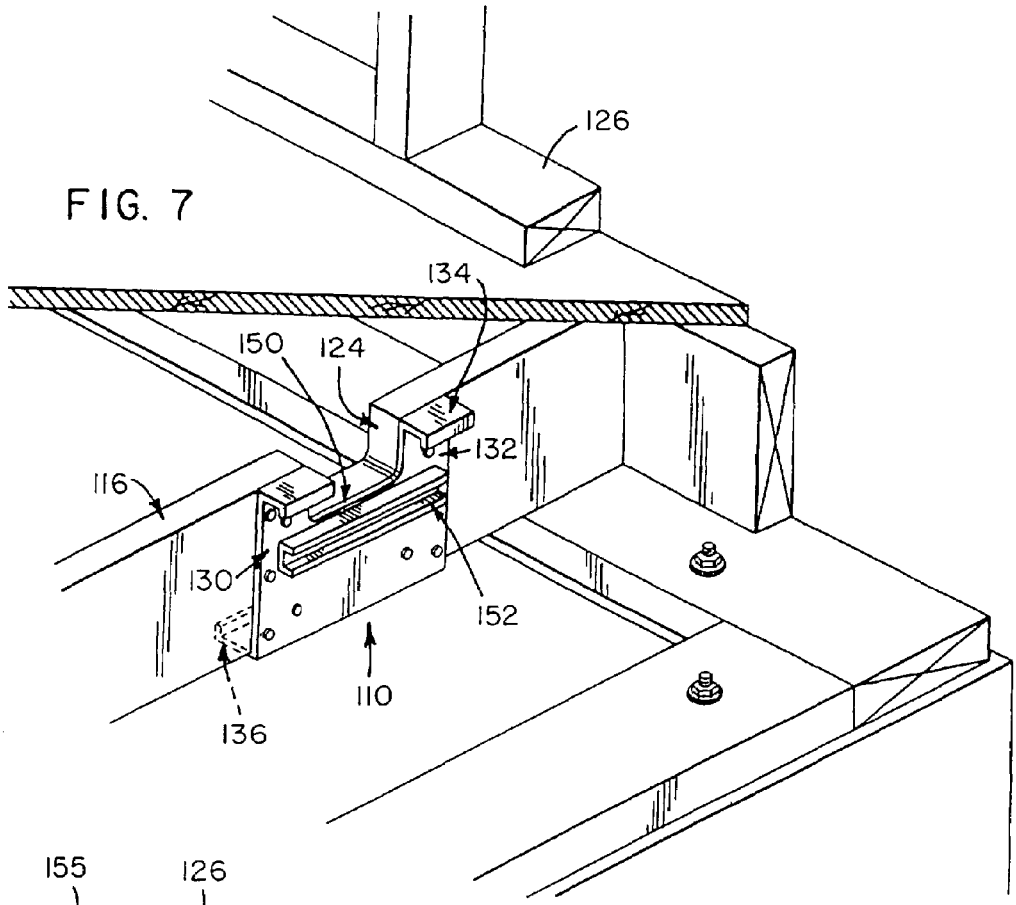
FIG. 7 is a perspective view of another alternative joist reinforcing bracket in accordance with the present invention positioned within a floor system.
Figure 9:
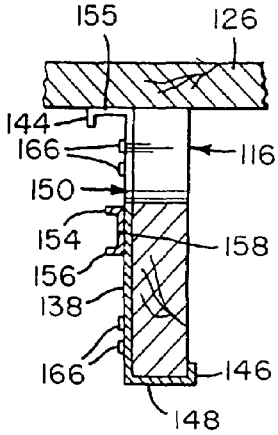
FIG. 9 is a cross-sectional view taken along line 9-9 of FIG. 8.
Figure 8:
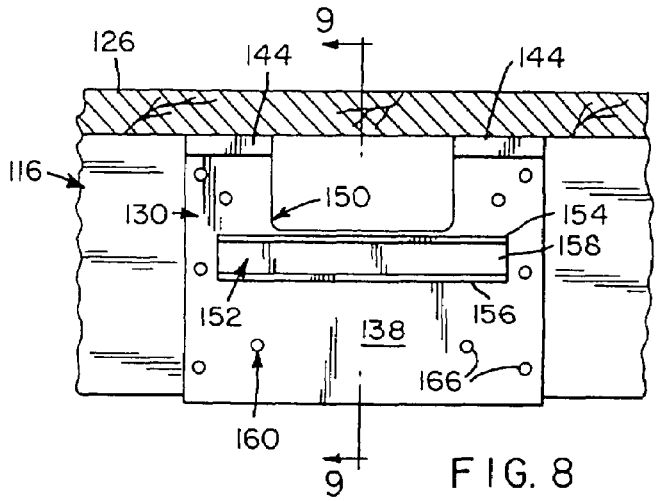
FIG. 8 is a front view of the joist reinforcing bracket of FIG. 7.

Referring now to FIGS. 7-9, another alternative embodiment of the joist reinforcing bracket is illustrated generally at 110. Bracket 110 includes elements that correspond generally to those of bracket 10 described above. Here, however, bracket 110 has been modified so as to be stiffer and so as to closely engage a joist 116 that is rectangular in cross section rather than I-shaped in cross section.

Bracket 116 includes a body 130 being formed of steel sheeting and having an S-shaped cross section. Body 130 has a central portion 132 joining an upper portion 134 and a lower portion 136. Central portion 132 has a planar, base wall 138 to which is welded a brace 152 of C-shaped cross section. Extending forwardly at right angles from the top of base wall 138 is a top wall 155 being one part of upper portion 134. Upper portion 134 also includes a forward wall 144 extending downwardly at right angles from the front of top wall 155. Lower portion 136 has a bottom wall 148 extending rearwardly at right angles from the bottom of base wall 138 and a rearward wall 146 extending upwardly at right angles from the rear of bottom wall 148. Thus, body 130 omits the intermediate and front walls 40-46 of body 30.

Body 130 has a notch 150 of rectangular outline for the passage of one or more conduits. Notch 150 extends downwardly through top wall 155 and forward wall 144 and into the top of base wall 138. As shown, top and forward walls 155 and 144 are fully bifurcated by notch 150.

Brace 152, formed of steel sheeting, is positioned beneath notch 150. Brace 152 has a pair of forwardly-extending, interior walls 154 and 156 joined by a back wall 158 into a C-shape. Back wall 158 is welded to base wall 138 with interior walls 154 and 156 being oriented parallel to top wall 155 and bottom wall 148. Preferably, brace 152 extends substantially the length of bracket 110.

A number of small holes as at 160 are provided in body 130 to permit the passage of screws or nails 166 to fasten bracket 110 to joist 116. The holes 160 are positioned in base wall 138 around notch 150 and brace 152 so that a strong bond between joist 116 and bracket 110 can be obtained. Adhesives can also be used to increase the strength of said bond.

Use of the invention will be described in relation to bracket 110 and joist 116 with the use of brackets 10 and 210 being substantially identical. First, a notch 124 is cut in joist 116 of sufficient size to accommodate a conduit (not shown). Next, bracket 110 is positioned so that: 1) lower portion 136 wraps around the bottom of joist 116, 2) center portion 132 is flush against the front of joist 116 with notch 124 being centered in the middle of notch 150, and 3) upper portion 134 extends away from joist 116 and is positioned to abut the bottom of plywood subfloor 126. Then, nails 166 are driven through holes 160 into joist 116 to secure bracket 110 thereto. The bracket attachment process requires just a few minutes to complete and can be accomplished by unskilled laborers using conventional tools.

When any of brackets 10, 110 or 210 is properly installed on a joist having a notch as described above, the joist will be reinforced to be at least equal in load-bearing capacity to that of a similarly dimensioned joist that lacks a notch. Since a reinforced joist obtains its principal strength from the inventive bracket, a notch may be provided virtually anywhere in the joist without a reduction of its load-bearing capacity.

From the foregoing, it should be apparent that brackets 10, 110 and 210 provide builders with great flexibility in positioning conduits within floor systems assembled with wooden joists. It should be noted also that by using brackets 10, 110 and 210 in situations where notches are present, wooden joists with somewhat smaller dimensions than would otherwise be permitted by local building codes might be employed. Thus, inventive brackets 10, 110 and 210 contribute to the conservation of wood while simultaneously reducing building costs.

While the invention has been described with a high degree of particularity, it will be appreciated by those skilled in the art that modifications may be made thereto. For example, bracket 110 could be provided with holes in top wall 155 in the manner shown in bracket 210 for a more secure fastening to subfloor 126. Therefore, it is to be understood that the present invention is not limited to the various embodiments described above, but encompasses any and all embodiments within the scope of the following claims.

I claim:

1. A bracket for reinforcing a wooden joist, comprising: a body including:

a central portion having a base wall for positioning against one side of a wooden joist, said base wall having a top, a bottom and opposed sides, said base wall also having a notch positioned in the top thereof midway between said opposed sides for the passage of a utility conduit extending through the wooden joist;

an upper portion being integrally formed with said central portion, said upper portion having a first wall being secured to and extending forwardly at right angles from the top of said base wall and a second wall being secured to and extending at right angles from the front of said first wall, said notch extending upwardly through said first wall and said second wall so as to split each of said first wall and said second wall into two segments of substantially equal length being positioned side-by-side; and, a lower portion being integrally formed with said central portion, said lower portion having a third wall being secured to and extending at right angles from the bottom of said base wall and a fourth wall being secured to and extending at right angles from said third wall, said third wall being parallel to said first wall, and said fourth wall being parallel to said second wall and said base wall; and, a brace being welded to said base wall beneath said notch, said brace including a back wall positioned flush against said base wall, said back wall extending from one of said opposed sides of said base wall to the other of said opposed sides, said brace also having a pair of interior walls respectively extending forwardly at right angles from the top and bottom of said back wall, said interior walls being parallel to one another and to said first wall and said third wall, and said interior walls extending from one of said opposed sides of said back wall to the other of said opposed sides.

2. The bracket according to claim 1 wherein said body further includes a plurality of holes positioned above and below said brace for receiving penetrating fasteners to fasten said bracket to the wooden joist.

3. The bracket according to claim 1 wherein said second wall extends upwardly from said first wall, said third wall extends forwardly from said base wall, and said fourth wall extends downwardly from the front of said third wall.

4. The bracket according to claim 3 further comprising a fifth wall secured to and extending rearwardly at right angles from the bottom of said fourth wall for engaging the bottom of the wooden joist.

5. The bracket according to claim 3 further comprising a sixth wall secured to and extending forwardly at right angles from the top of said second wall, and said notch extending upwardly through said sixth wall so as to split said sixth wall into pieces of substantially equal length being positioned side-by-side.

6. The bracket according to claim 1 wherein said second wall extends downwardly from said first wall, said third wall extends rearwardly from said base wall, and said fourth wall extends upwardly from the rear of said third wall.

* * * * *